US009394774B2

(12) United States Patent
Soliman et al.

(10) Patent No.: US 9,394,774 B2
(45) Date of Patent: Jul. 19, 2016

(54) METHODS AND DEVICES FOR HYDRAULIC FRACTURING DESIGN AND OPTIMIZATION: A MODIFICATION TO ZIPPER FRAC

(71) Applicant: Texas Tech University System, Lubbock, TX (US)

(72) Inventors: Mohamed Soliman, Lubbock, TX (US); Mehdi Rafiee, Lubbock, TX (US); Elias Pirayesh, Lubbock, TX (US)

(73) Assignee: Texas Tech University System, Lubbock, TX (US)

( * ) Notice: Subject to any disclaimer, the term of this patent is extended or adjusted under 35 U.S.C. 154(b) by 0 days.

(21) Appl. No.: 13/970,880

(22) Filed: Aug. 20, 2013

(65) Prior Publication Data

US 2014/0048270 A1 Feb. 20, 2014

Related U.S. Application Data

(60) Provisional application No. 61/691,124, filed on Aug. 20, 2012.

(51) Int. Cl.
*E21B 43/26* (2006.01)

(52) U.S. Cl.
CPC ..... *E21B 43/26* (2013.01)

(58) Field of Classification Search
USPC ..... 166/308.1
See application file for complete search history.

(56) References Cited

U.S. PATENT DOCUMENTS

| | | | |
|---|---|---|---|
| 8,126,689 | B2 | 2/2012 | Soliman et al. |
| 8,210,257 | B2 | 7/2012 | Dusterhuft et al. |
| 2004/0023816 | A1 | 2/2004 | Burts, III |
| 2009/0194273 | A1 | 8/2009 | Surjaatmadja et al. |
| 2011/0017458 | A1 | 1/2011 | East, Jr. et al. |
| 2011/0029293 | A1 | 2/2011 | Petty et al. |
| 2012/0152550 | A1 | 6/2012 | East, Jr. et al. |

OTHER PUBLICATIONS

Cipolla, C.L., et al., Reservoir Modeling in Shale-Gas Reservoirs. Paper SPE 125530-MS presented at the SPE Eastern Regional Meeting, Charleston, West Virginia, USA, Sep. 23-25.

Cipolla, C.L., et al., 2010. The Relationship Between Fracture Complexity, Reservoir Properties, and Fracture-Treatment Design. SPE Production & Operations (4): 438-452.

East, L.E., et al., 2010. Methods for Enhancing Far-field Complexity in Fracturing Operations. SPE Production & Operations (3): 291-303.

Mayerhofer, M.J., et al., 2010. What Is Stimulated Reservoir Volume? SPE Production & Operations (1): 89-98.

Mayerhofer, M.J., et al., 2008. What is Stimulated Rock Volume? Paper SPE 119890-MS presented at the SPE Shale Gas Production Conference, Fort Worth, Texas, USA, February.

Nagel, N.B., et al., 2011. Stress Shadowing and Microseismic Events: A Numerical Evaluation. Paper SPE 147363-MS presented at the SPE Annual Technical Conference and Exhibition, Denver, Colorado, USA, Oct. 30-Nov. 2.

(Continued)

*Primary Examiner* — Taras P Bemko
(74) *Attorney, Agent, or Firm* — Chainey P. Singleton; Edwin S. Flores; Chalker Flores, LLP

(57) ABSTRACT

The present invention provides a method of optimizing the placement of fractures along deviated wellbores by hydraulically fracturing a well to form a complex fracture network of hydraulically connected fractures.

18 Claims, 15 Drawing Sheets

(56) References Cited

OTHER PUBLICATIONS

Navigant Consulting. 2008. North America Natural Gas Assessment. Prepared for American Clean Skies Foundation.

Roussel, N.P., et al., 2011. Strategies to Minimize Frac Spacing and Stimulate Natural Fractures in Horizontal Completions. Paper SPE 146104-MS presented at the SPE Annual Technical Conference and Exhibition, Denver, Colorado, USA, Oct. 30-Nov. 2.

Roussel, N.P., et al., 2011. Optimizing Fracture Spacing and Sequencing in Horizontal-Well Fracturing. SPE Production & Operations (2): 173-184.

Sneddon, I.N. 1946. The Distribution of Stress in the Neighborhood of a Crack in an Elastic Solid. Proceedings of the Royal Society of London, A (187): 229-60.

Soliman, M.Y., et al., 2008. Geomechanics Aspects of Multiple Fracturing of Horizontal and Vertical Wells. SPE Drilling & Completion (3): 217-228.

Soliman, M.Y., East, L.E., and Augustine, J.R. 2010. Fracturing Design Aimed at Enhancing Fracture Complexity. Paper SPE 130043-MS presented at the SPE EUROPEC/EAGE Annual Conference and Exhibition, Barcelona, Spain, Jun. 14-17.

Warpinski, N.R., et al., 2009. Stimulating Unconventional Reservoirs: Maximizing Network Growth While Optimizing Fracture Conductivity. Journal of Canadian Petroleum Technology (10): 39-51.

Warpinski, N.R., et al., 2004. Analysis and Prediction of Microseismicity Induced by Hydraulic Fracturin. SPE Journal (1): 24-33.

Waters, G.A., et al., 2009. Simultaneous Hydraulic Fracturing of Adjacent Horizontal Wells in the Woodford Shale. SPE paper 119635-MS presented at the SPE Hydraulic Fracturing Technology Conference, Woodlands, Texas, Jan. 19-21.

International Search Report (KIPO) PCT/US2013/055744 dated Nov. 21, 2013.

A

B

C

D

E

F

METHODS AND DEVICES FOR HYDRAULIC FRACTURING DESIGN AND OPTIMIZATION: A MODIFICATION TO ZIPPER FRAC

CROSS-REFERENCE TO RELATED APPLICATIONS

This application claims priority based on U.S. Provisional Application No. 61/691,124, filed Aug. 20, 2012. The contents of which is incorporated by reference in its entirety.

TECHNICAL FIELD OF THE INVENTION

The present invention relates generally to compositions and methods for hydraulic fracturing of an earth formation and in particular, to compositions and methods for hydraulic fracturing that reduces stress contrast during fracture propagation while enhancing far field complexity and maximizing the stimulated reservoir volume.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with hydraulic fracturing to enhance production of trapped hydrocarbons. Conventional fracture designs focus on the creation of a fracture of desirable length, height and width. Such considerations typically lead to a fracture design using a reasonably high pump rate and as low a viscosity of the fracturing fluid as possible given the viscosity requirement for the desired fracture size.

In recent years, new fracturing designs and techniques have been developed to enhance production of trapped hydrocarbons. The new techniques focus on reducing stress contrast during fracture propagation while enhancing far field complexity and maximizing the stimulated reservoir volume.

For example, U.S. Pat. No. 8,210,257, incorporated herein by reference, entitled "Fracturing a stress-altered subterranean formation" disclose a well bore in a subterranean formation includes a signaling subsystem communicably coupled to injection tools installed in the well bore. Each injection tool controls a flow of fluid into an interval of the formation based on a state of the injection tool. Stresses in the subterranean formation are altered by creating fractures in the formation. Control signals are sent from the well bore surface through the signaling subsystem to the injection tools to modify the states of one or more of the injection tools. Fluid is injected into the stress-altered subterranean formation through the injection tools to create a fracture network in the subterranean formation. In some implementations, the state of each injection tool can be selectively and repeatedly manipulated based on signals transmitted from the well bore surface. In some implementations, stresses are modified and/or the fracture network is created along a substantial portion and/or the entire length of a horizontal well bore.

Still another example includes U.S. Patent Application Publication No. 2011/0017458, incorporated herein by reference, which discloses a method of inducing fracture complexity within a fracturing interval of a subterranean formation comprising characterizing the subterranean formation, defining a stress anisotropy altering dimension, providing a wellbore servicing apparatus configured to alter the stress anisotropy of the fracturing interval of the subterranean formation, altering the stress anisotropy within the fracturing interval, and introducing a fracture in the fracturing interval in which the stress anisotropy has been altered. A method of servicing a subterranean formation comprising introducing a fracture into a first fracturing interval, and introducing a fracture into a third fracturing interval, wherein the first fracturing interval and the third fracturing interval are substantially adjacent to a second fracturing interval in which the stress anisotropy is to be altered.

Still another example includes U.S. Patent Application Publication No. 2004/0023816, incorporated herein by reference, which discloses a hydraulic fracturing treatment to increase productivity of subterranean hydrocarbon bearing formation, a hydraulic fracturing additive including a dry mixture of water soluble crosslinkable polymer, a crosslinking agent, and a filter aid which is preferably diatomaceous earth. The method of forming a hydraulic fracturing fluid includes contacting the additive with water or an aqueous solution, with a method of hydraulically fracturing the formation further including the step of injecting the fluid into the wellbore.

SUMMARY OF THE INVENTION

Creation of complex fracture networks away from the wellbore may not be achieved by conventional fracturing techniques. Recently developed techniques are designed to overcome this problem however; those techniques are operationally difficult to perform. This invention discloses a method that creates complex fracture networks while it is operationally simple to practice.

The invention discloses a method for enhancing far field complexity in subterranean formations during hydraulic fracturing treatments by means of optimizing the placement of fractures along the deviated wellbores. In this method two parallel laterals (deviated wells) may be hydraulically fractured in a specific sequence to alter the stress anisotropy in the formation. Single and/or multiple cluster (fractures) stages can be designed to achieve the desired complexity in the formation. If single cluster stages are to be designed, fractures can be placed such that after introducing the first and the second fractures in one of the wells, the third fracture may be created in the other well in a distance between the first two fractures. The third fracture extends to the area between the first two fractures and alters the stress field (changes the magnitude of horizontal stresses) in that region. Since fractures tend to open in a direction perpendicular to the direction of minimum horizontal stress, the change in magnitude of SH minimum is larger than the change in the magnitude of SH maximum. Thus, after introducing the third fracture the different between two principal horizontal stresses (stress anisotropy) approaches zero. When there is no stress anisotropy in the subterranean formation, fractures may open in any direction and connect to the pre-existing network of natural fractures which eventually results in the creation of a complex network of fractures. A complex network of hydraulically connected fractures may improve the production of trapped hydrocarbons in tight subterranean formations such as shale and tight sand reservoirs.

The disclosed method can be used to design new fracturing schemes based on mechanical properties of the subterranean formation. The ultimate objective of the disclosed invention is to enhance production from unconventional reservoirs by optimizing the fracture placement in hydraulic fracturing designs.

The novel designs in placement of fractures, sequencing of the fractures and also in well spacing make this invention unique.

The present invention provides a method of optimizing the placement of fractures along deviated wellbores by identifying at least two parallel lateral wellbores in a subterranean formation comprising at least a first wellbore and a second wellbore; introducing a first fracture and a second fracture in the first wellbore; introducing a third fracture in the second wellbore between the first fracture and the second fracture, wherein the third fracture extends to an intermediate area between the first two fractures and alters the stress field in that region; and forming one or more complex fractures extending from the first fracture, the second fracture, the third fracture or a combination thereof to form a complex fracture network. In addition, the present can include the step of introducing a third parallel lateral wellbore in the subterranean formation and introducing a fourth fracture that extends between 2 fractures in the first wellbore, the second wellbore or both to alter the stress field in a region. In addition, the present can include the step of introducing at least a fifth fracture in the first wellbore, the second wellbore or the third parallel lateral wellbore wherein the fifth fracture extends between 2 fractures in the first wellbore, the second wellbore or the third parallel lateral wellbore to alter the stress field in a region. In addition, the present can include the step of introducing numerous fractures in the first wellbore, the second wellbore and/or the third parallel lateral wellbore wherein the numerous fractures extends between 2 fractures to alter the stress field in a region. The present invention can include repeating fractures in any and all parallel lateral wellbores to produce a latter profile of two fractures from one parallel lateral wellbore being on opposite sides of a fracture from an adjacent parallel lateral wellbore. In addition, the present invention may include numerous parallel lateral wellbores positions in proximity to other parallel lateral wellbores to allow a latter profile of two fractures from one parallel lateral wellbore being on opposite sides of a fracture from an adjacent parallel lateral wellbore.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
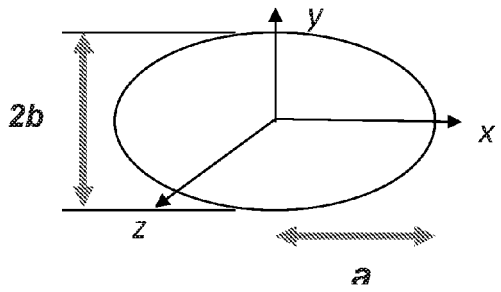
FIG. 1 is an image of the geometry of a flat elliptical crack.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

As used herein, the symbol $\sigma_z$ is used to denote the effective stress in z direction, psi.

As used herein, the symbol $\sigma_x$ is used to denote the effective stress in x direction, psi.

As used herein, the symbol $\sigma_y$ is used to denote the effective stress in y direction, psi.

As used herein, the symbol G is used to denote the shear modulus, psi.

As used herein, the symbol $V_r$ is used to denote the Poisson's ratio.

As used herein, the symbol $\phi$ is used to denote the potential function.

As used herein, the symbol $\tau_{xy}$ is used to denote the shear stress in xy plane, psi.

As used herein, the symbol $\tau_{xz}$ is used to denote the shear stress in xz plane, psi.

As used herein, $\tau_{yz}$ is used to denote the shear stress in yz plane, psi.

As used herein, the symbol z is used to denote the complex variable.

As used herein, the symbol Z is used to denote the coordinate axis normal to fracture plane, ft.

Unless otherwise specified, use of the term "subterranean formation" shall be construed as encompassing both areas below exposed earth and areas below earth covered by water such as ocean or fresh water.

It has been well established that hydraulic fractures in earth formations emanating from a wellbore will form generally opposed fracture wings which extend along and lie in a plane which is normal to the minimum in situ horizontal stress in the formation zone being fractured. Ideally, the fractures form as somewhat identical opposed "wings" extending from a wellbore which has been perforated in several directions with respect to the wellbore axis. This classic fracture configuration holds generally for formations which have been penetrated by a substantially vertical well and for formations which exhibit a minimum and maximum horizontal stress distribution which intersect at an angle of approximately 90 degree.

Zipper frac is one technique to enhance production of trapped hydrocarbons which involves simultaneous stimulation of two parallel horizontal wells from toe to heel. In this technique, created fractures in each cluster propagate toward each other so that the induced stresses near the tips force fracture propagation to a direction perpendicular to the main fracture.

The present invention provides a new design to optimize fracturing of two laterals both from rock mechanic and also fluid production aspects and is a modification to zipper frac where fractures are initiated in a staggered pattern. The modified zipper frac improves the performance of fracturing treatment comparing to the original zipper frac by means of increasing contact area and eventually enhancing fluid production. A comparison of the two techniques with alternating fracturing in which fractures are placed alternatively starting from the toe of the horizontal wellbore and moving towards the heel.

The present invention provides a techniques focus on reducing stress contrast during fracture propagation while enhancing far field complexity and maximizing the stimulated reservoir volume. Zipper frac is one of the current fracturing techniques, which involves simultaneous stimulation of two parallel horizontal wells from toe to heel. In this technique, created fractures in each cluster propagate toward each other so that the induced stresses near the tips force fracture propagation to a direction perpendicular to the main fracture. The effectiveness of zipper frac has been approved by the industry; however, the treatment's optimization is still under discussion. The new design is a modification to zipper frac, where fractures are initiated in a staggered pattern. The effect of well spacing on the changes in normal stress has been evaluated analytically to optimize the design. Results demonstrate that the modified zipper frac improves the performance of fracturing treatment when compared to the original zipper frac by means of increasing contact area and eventually enhancing fluid production.

Hydraulic fracturing is a stimulation technique used to extract trapped hydrocarbon. Fracturing vertical wells was used for variety of reservoir conditions varying from tight gas formations to high permeability formations implementing the FracPac applications. Fracturing horizontal wells started in the late 80's for stimulation of tight gas formation. The use of fracturing horizontal wells proved to a key technology in the development of unconventional reservoirs. The technique has been widely used with the development of Barnett shale in the late 90s (Navigant Consulting, 2008). While the existence of natural fractures in shale oil and gas plays make them good candidates for hydraulic fracturing, the key in a successful treatment is creating a complex network that connects created hydraulic fractures with pre-existing natural fractures. This network of fractures, which consist of hydraulic fractures, primary and secondary natural fractures, are highly desired in low permeability reservoirs where higher conductive connectivity can be achieved as opposed to connectivity created by planar fractures (Soliman et al. 2010). Numerical simulations (Mayerhofer et al. (2008); Nagel and Sanchez-Nagel (2011); Warpinski et al. (2009); Cipolla et al. (2009) show that creating an interconnected network of fractures in nano-permeable reservoirs is a major factor in economic production. Various methods have been applied to create this complex network and ultimately maximize the total Stimulated Reservoir Volume (SRV). Creating secondary fractures is a vital occurrence in increasing the reservoir contact. Secondary fractures can be created by multistage fracturing along a horizontal wellbore in a naturally fractured reservoir. Different design parameters including the number of perforation clusters per stage, the spacing between stages, the length of the horizontal well, the sequence of fracturing operations, and the type and quantity of proppant should be optimized to create secondary fractures and a complex network of fractures (Mayerhofer et al. 2010). Among these parameters, spacing between perforation clusters as well as fracturing stages play major roles in fracture propagation and geometry. As noted by Soliman et al. (2008), the spacing between fractures is limited by the stress perturbation caused by the opening of propped fractures. However, fracturing designs can be optimized if the original stress anisotropy is known and the stress perturbation can be predicted (Soliman et al. 2010).

Recent advances in fracturing design (East et al. 2010; Cipolla et al. 2010; Roussel and Sharma 2011; Waters et al. 2009) offer techniques for creating far field fracture complexity to enhance the SRV. Zipper frac is one of these techniques in which two horizontal wellbores are fractured simultaneously to maximize stress perturbation near the tips of each fracture. The problem with this technique is that the creation of complexity is limited to the area near the tips of the fractures. In another approach, a horizontal wellbore is fractured alternatively so that the area between two created fractures is altered by the stresses induced from introducing a third fracture in the middle. While enhancing the reservoir contact area and the SRV, this new design is operationally difficult to perform in horizontal wellbores.

The present invention provides designs of fracture placement and offer an alternative approach. The new approach is a modification to zipper frac, where fractures are designed in a staggered pattern to induce stress in the surrounding formation. The induced stresses will alter the pre-existing natural fractures and create secondary fractures necessary for creating a complex network. The modified zipper frac (MZF) design enhances the fracture complexity and is operationally simple to practice. MZF design considers the geomechanics involved in fracturing treatment and provides a unique opportunity for operators to maximize reservoir contact.

Stress Interference Calculations around Different Fracture Geometries. Introducing hydraulic fractures in a brittle or heterogeneous rock can cause an altered stress field in the vicinity of the fracture. The change in stress is attributed to the opening of the hydraulic fractures and depends on the mechanical properties of the rock, the geometry of the fracture, and the pressure inside the fracture (Warpinski et al. 2004). Sneddon (1946) and Sneddon and Elliot (1946) presented solutions for semi-infinite, penny-shaped, and arbitrarily shaped fractures. An analytical solution was developed by Green and Sneddon (1950) to calculate the stresses around a flat, elliptical crack. The solution is presented for a crack with constant internal pressure in a homogenous elastic medium. The geometry of an elliptical crack is shown in FIG. 1. FIG. 1 is an image of the geometry of a flat elliptical crack. As shown by Warpinski et al. (2004), the stresses for this solution can be directly calculated from:

$$\sigma_x + \sigma_y = -8G\left[(1-2\nu_r)\frac{\partial^2\phi}{\partial Z^2} + \frac{\partial^3\phi}{\partial Z^3}\right] \tag{1}$$

$$\sigma_x - \sigma_y + 2i\tau_{xy} = 32G\frac{\partial^2}{\partial \bar{z}^2}\left[(1-2\nu_r)\phi + Z\frac{\partial\phi}{\partial Z}\right] \tag{2}$$

$$\sigma_z = -8G\frac{\partial^2\phi}{\partial Z^2} + 8GZ\frac{\partial^3\phi}{\partial Z^3} \tag{3}$$

$$\tau_{xz} + i\tau_{yz} = 16GZ\frac{\partial^3\phi}{\partial \bar{z}\partial Z^2} \tag{4}$$

FIGS. 2-5 show the solutions for stress interference caused by the presence of a penny-shaped, an elliptical, and a semi-infinite fracture in an elastic medium. In these figures, stress distributions are calculated in the direction of minimum horizontal stress ($\sigma_z$), maximum horizontal stress ($\sigma_x$), and ($\sigma_y$) vertical stress. These distributions are then plotted versus distance normal to fracture normalized by half-height. In this study, a solution for elliptical fractures is added.

Figure 2:
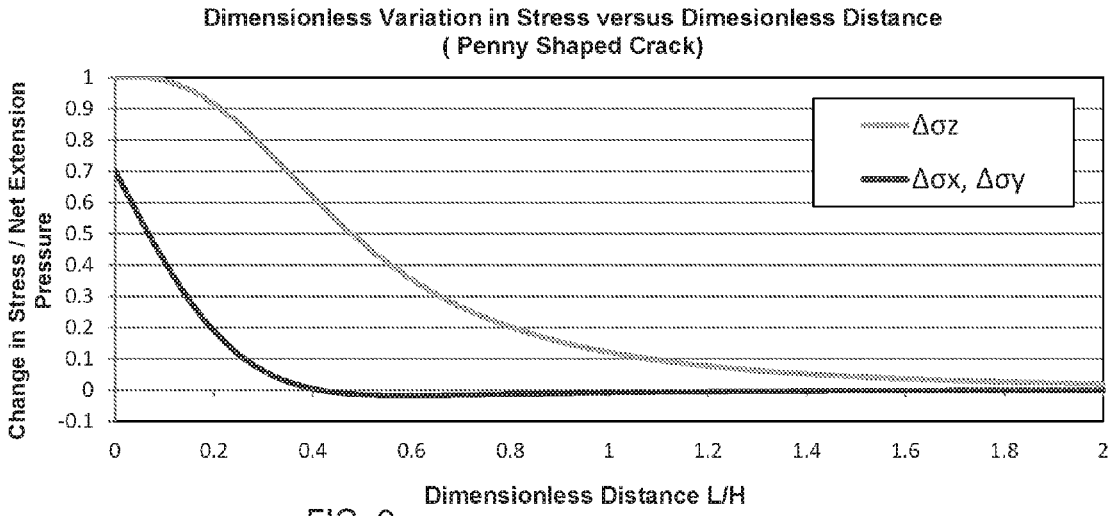
FIG. 2 is a graph of the stress interference in presence of a penny-shaped fracture.

Stress Interference Caused by Presence of a Penny-Shaped Fracture. FIG. 2 is a graph of the stress interference in presence of a penny-shaped fracture. A solution for stress perturbation due to the presence of a penny-shaped crack was developed by Sneddon in 1946. This solution is presented in FIG. 2. Because of the symmetry in penny-shaped geometry, changes in stress on the line of symmetry in the directions parallel to the plane of the fracture ($\sigma_x$, $\sigma_y$) are equal. The change that occurs to the minimum horizontal principal stress is always higher than the change in both maximum horizontal stress and vertical stress. This is because fractures normally tend to propagate in a direction perpendicular to the minimum horizontal stress where there is least resistance compared to the other directions.

Figure 3:
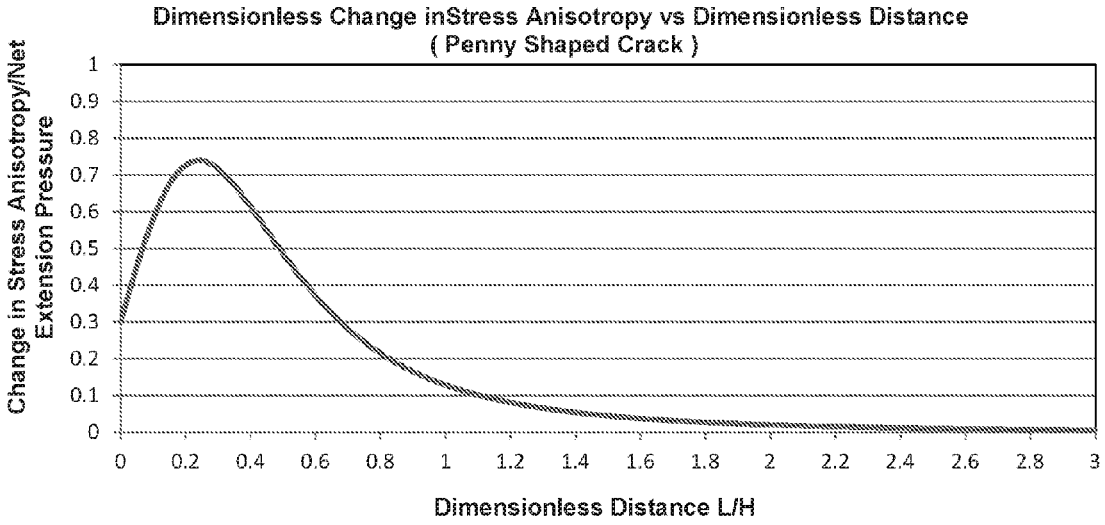
FIG. 3 is a graph of the change in stress anisotropy in presence of a penny-shaped fracture.

FIG. 3 is a graph of the change in stress anisotropy in presence of a penny-shaped fracture. This indicates that the difference between the two horizontal stresses will decline as we move away from the fracture. The change will reach maximum at about L/H=0.3. In case of limited stress contrast, it is possible that the orientation of the horizontal stresses would be reversed. In case of strike slip situation where the vertical stress is close to the minimum horizontal stress, reversal of orientation could mean creating a horizontal fracture. As Soliman et al. (2008) mentioned, the effect of creating multiple fractures is a cumulative one.

Stress Interference Caused by Presence of a Semi-Infinite Fracture. According to Sneddon and Elliott (1946), a semi-infinite fracture is a rectangular crack with limited height but infinite length; additionally, the width of the fracture is extremely small compared to its height and length. Sneddon and Elliott (1946) developed a mathematical solution for such a semi-infinite system.

Figure 4:
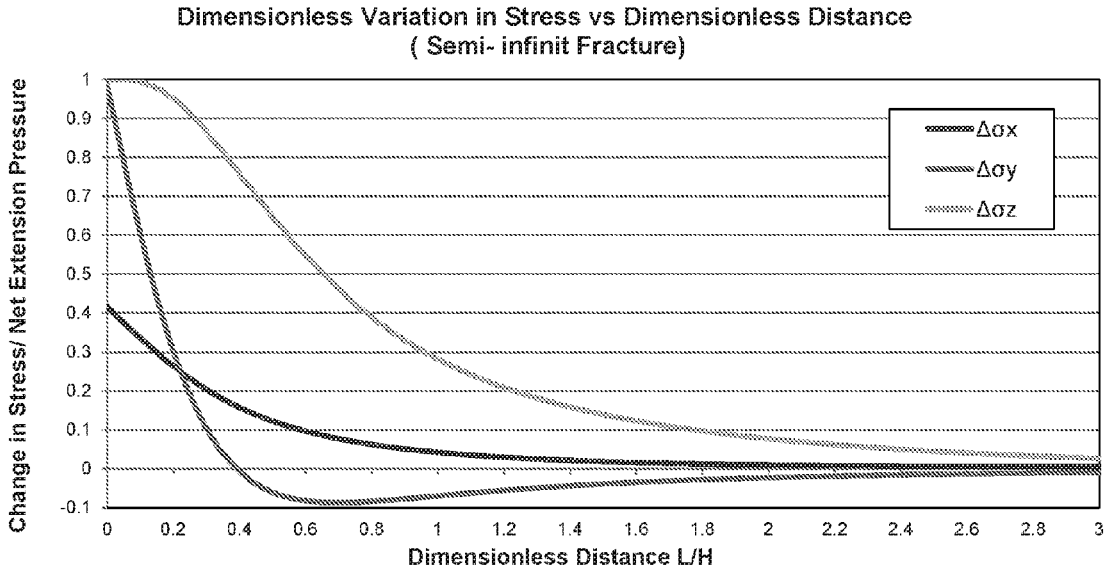
FIG. 4 is a graph of the stress interference in presence of a penny-shaped fracture.

The solution is presented in FIG. 4. FIG. 4 is a graph of the stress interference in presence of a penny-shaped fracture. The change in stress components over net pressure is plotted versus the distance perpendicular to the fracture plane normalized by the fracture height. Change in minimum horizontal stress is higher than change in other directions.

Figure 5:
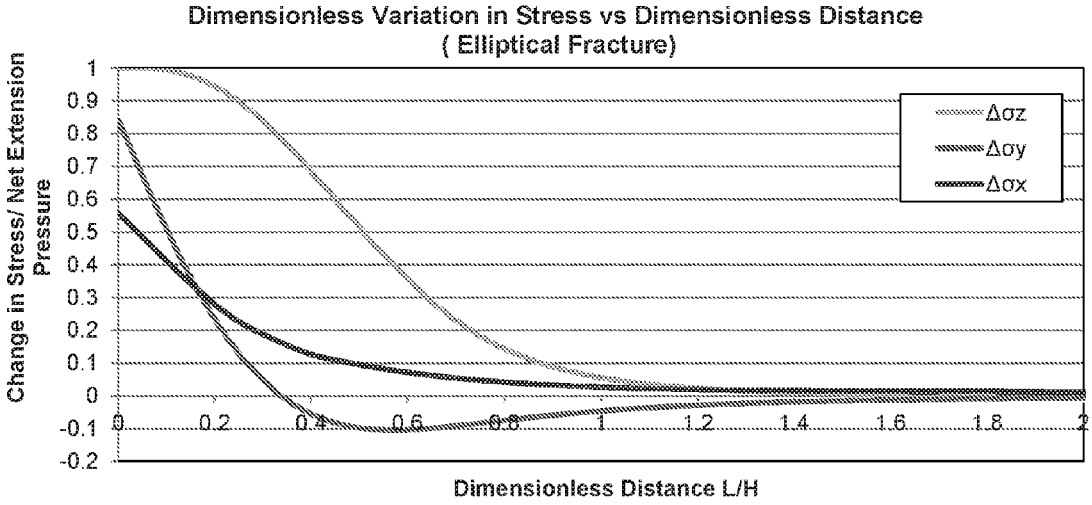
FIG. 5 is a graph of the stress change caused by the presence of an elliptical fracture.
Figure 6A:
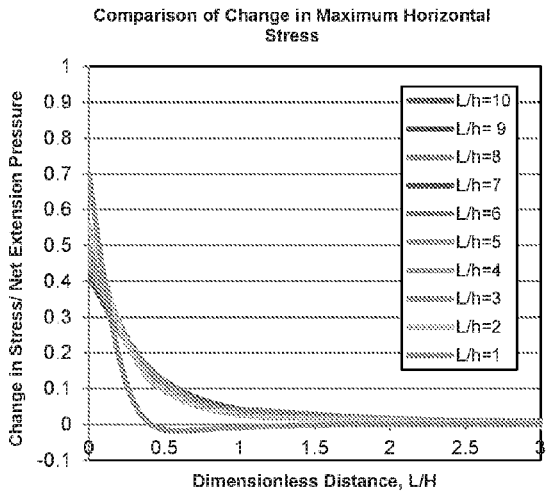
FIGS. 6A and 6B are graphs of the maximum and minimum stress perturbation for different fracture geometries.
Figure 6B:
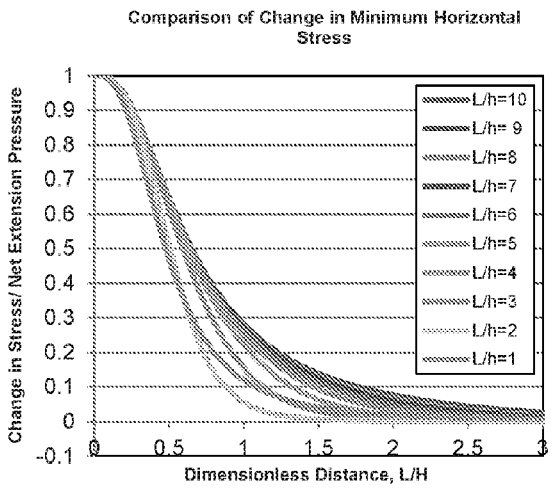
Figure 7:
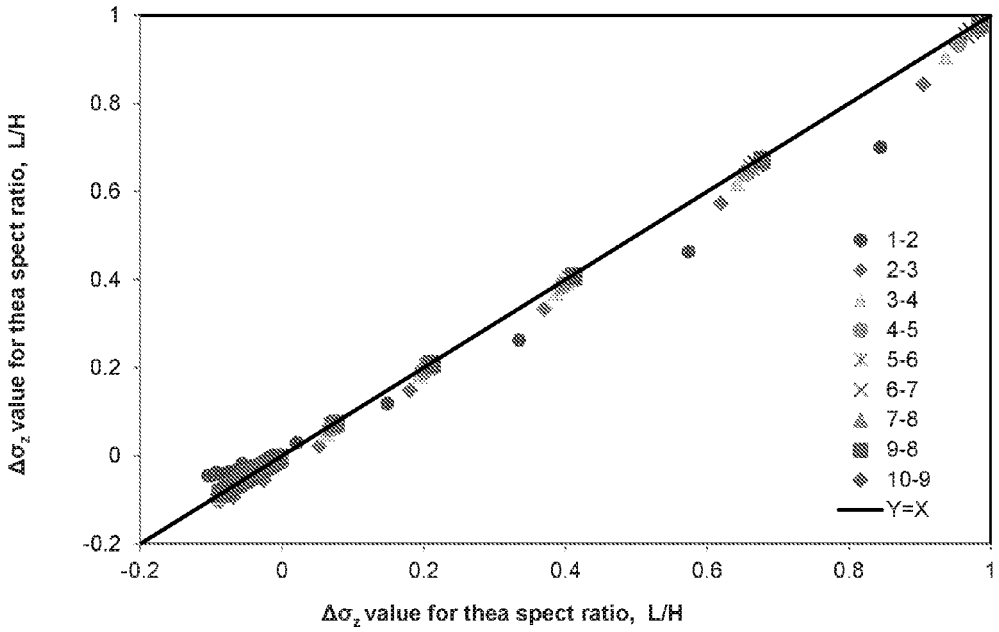
FIG. 7 is a plot of the cross-validation of nine sequences aspect ratios for 500 $\Delta\sigma Z$ data.

Stress perturbation caused by presence of an elliptical fracture. FIG. 5 is a graph of the stress change caused by the presence of an elliptical fracture. Elliptical fractures are more realistic compared to the other fracture geometries. Green and Sneddon (1950) studied the change in stress in the neighborhood of an elliptical crack in an elastic medium. FIG. 5 shows change in stress distribution due to the presence of an elliptical crack. The change in stress follows the same trend as a semi-infinite fracture. A comparison of changes in stress with respect to aspect ratio (L/H) is shown in FIGS. 6A-B. FIGS. 6A and 6B are graphs of the maximum and minimum stress perturbation for different fracture geometries. As FIGS. 6A-B show, stress in the horizontal plane changes with different fracture aspect ratios. However, this change is insignificant for L/H ratios higher than 5. FIG. 7 gives a percentage of difference for this comparison.

FIG. 7 is a plot of the cross-validation of nine sequences aspect ratios for 500 $\Delta\sigma Z$ data. In order to have nine comparisons between each two consecutive aspect ratios, 500 values of $\Delta\sigma_Z$ with respect to distance (x) are used in the cross-validation of the ten different aspect ratios. The examination of the cross-validation plots will give a better idea of the uncertainty of each comparison between sequences, as shown in FIG. 7. This figure shows that the clouds of data points are fairly close to the line Y=X, and that they are centered with reference to the line for the aspect ratios (L/H) of 5 and greater. In contrast, the clouds of data points for the sequences 3-4, 2-3, and 1-2 are more spacious than aforementioned aspect ratios, and they get wider for smaller sequences. Based on the cross-validation results, the difference between $\Delta\sigma_Z$ values of two consecutive aspect ratios is negligible for L/H>5. Cross-validations of the $\Delta\sigma_Z$ values obtained for the sequences 3-4, 2-3, and 1-2, seen in FIG. 7, clearly show that the differences between $\Delta\sigma_Z$ values of two consecutive aspect ratios are considerably higher for L/H<4.

Another type of error analysis has been performed on the same nine pairs of aspect ratios for 500 $\Delta\sigma_Z$ data to obtain the Mean of Relative Difference (MRD) using the following equation:

$$MRD_{i-j}(\%) = 100 \times \frac{\sum_{n=1}^{50} (\Delta\sigma_{Zj} - \Delta\sigma_{Zi})_n}{\sum_{n=1}^{50} (\Delta\sigma_{Z2} - \Delta\sigma_{Z1})_n} \tag{5}$$

where i and j represent aspect ratios and they change from 1 to 9 and 2 to 10, respectively.

Figure 8:
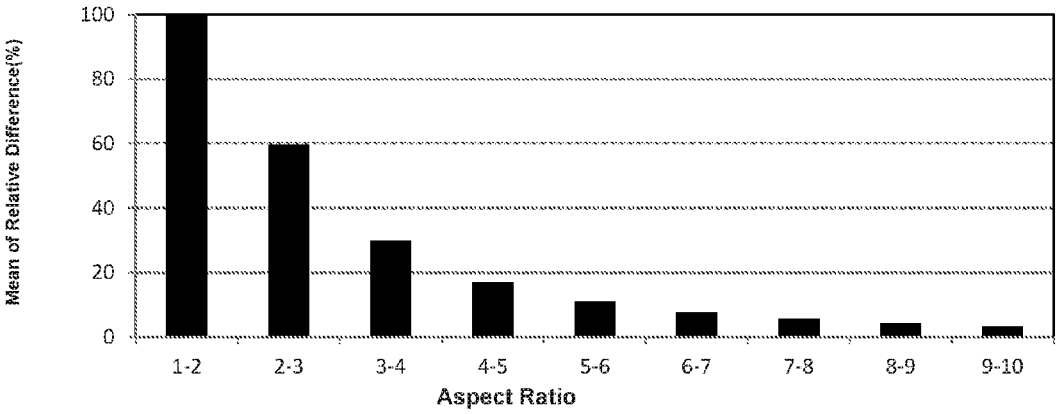
FIG. 8 is a bar graph of the mean of relative difference of nine pairs of aspect ratios for 500 $\Delta\sigma Z$ data.

FIG. 8 is a bar graph of the mean of relative difference of nine pairs of aspect ratios for 500 $\Delta\sigma Z$ data. Based on the MRD results, seen in FIG. 8, the MRD is less than 10% for L/H>5 and it increases exponentially with decreasing the aspect ratio. In other words, the difference of $\Delta\sigma Z$ values between two consecutive aspect ratios is insignificant for L/H>5. These results confirm the conclusions obtained from the cross-validation results.

Stress perturbation caused by the presence of multiple fractures. The study of stress interference in fracturing horizontal wells has become an important factor in designing and optimizing fracturing treatments. According to Soliman et al. (2010), stress interference increases as the number of open propped fracture increases.

Figure 9:
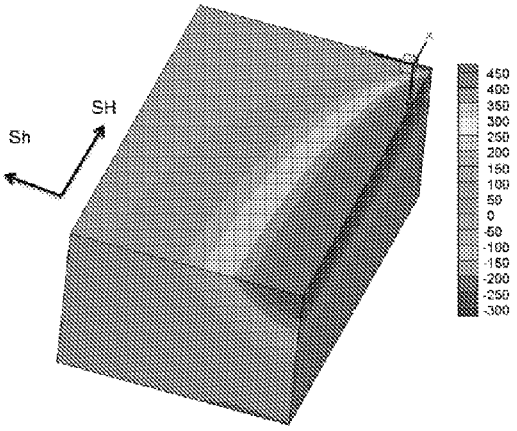
FIG. 9 is an image of a 3D visualization of change in minimum horizontal stress (psi).
Figure 10:
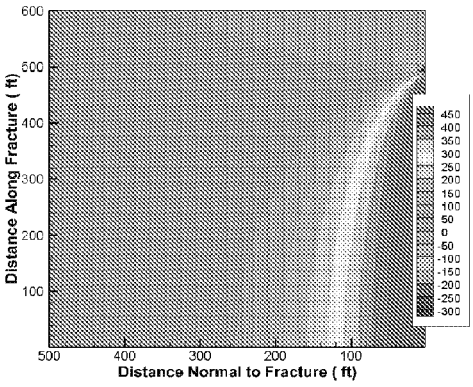
FIG. 10 is an image of a plan view of change in minimum horizontal stress.
Figures 11A, 11B, 11C, 11D, 11E, 11F:
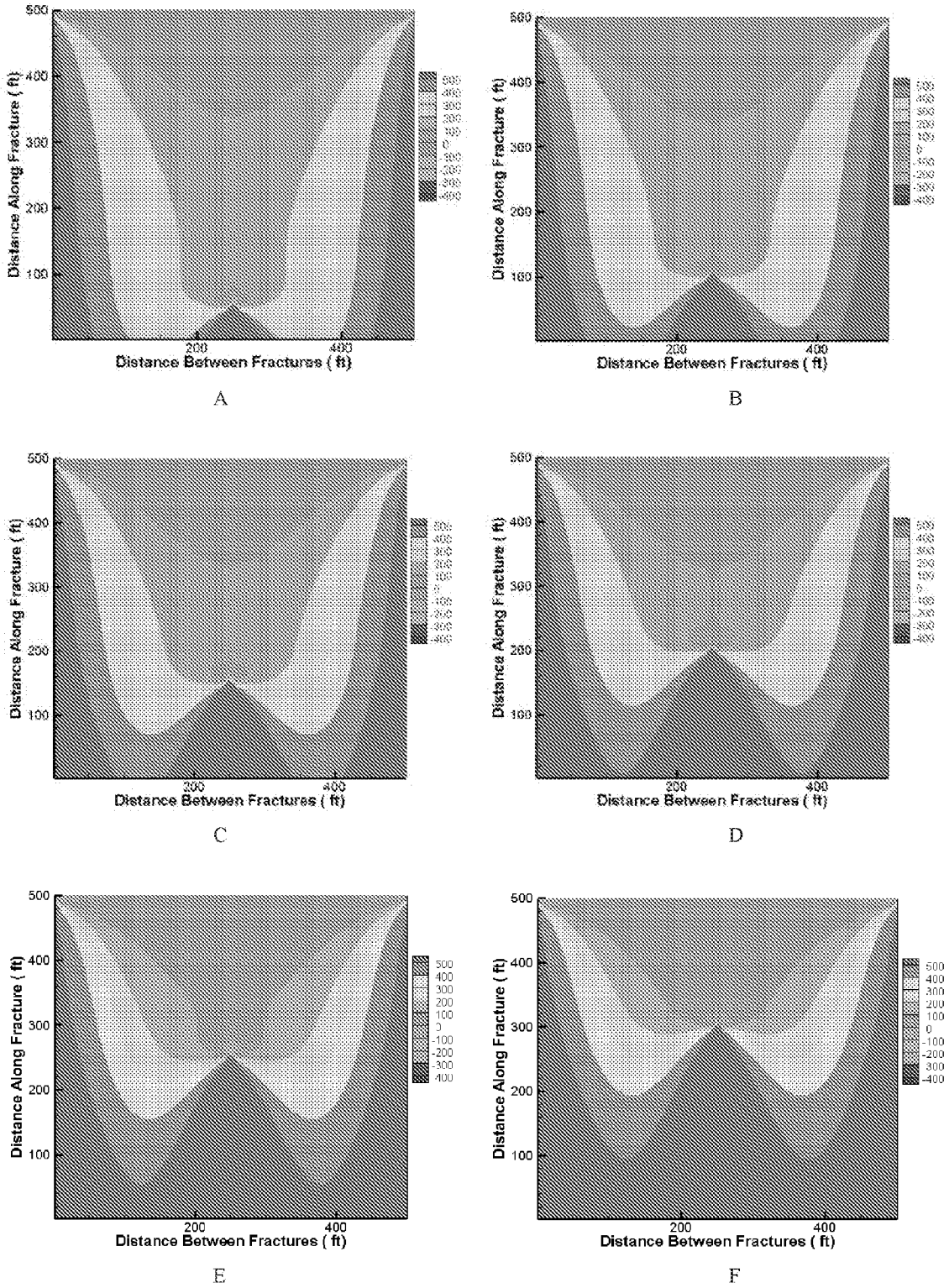
FIGS. 11A-11F are images of the change in Minimum Horizontal Stress for different fracture lengths (50, 100, 150, 200, 250, 300 ft).
Figures 12A, 12B, 12C, 12D, 12E, 12F:
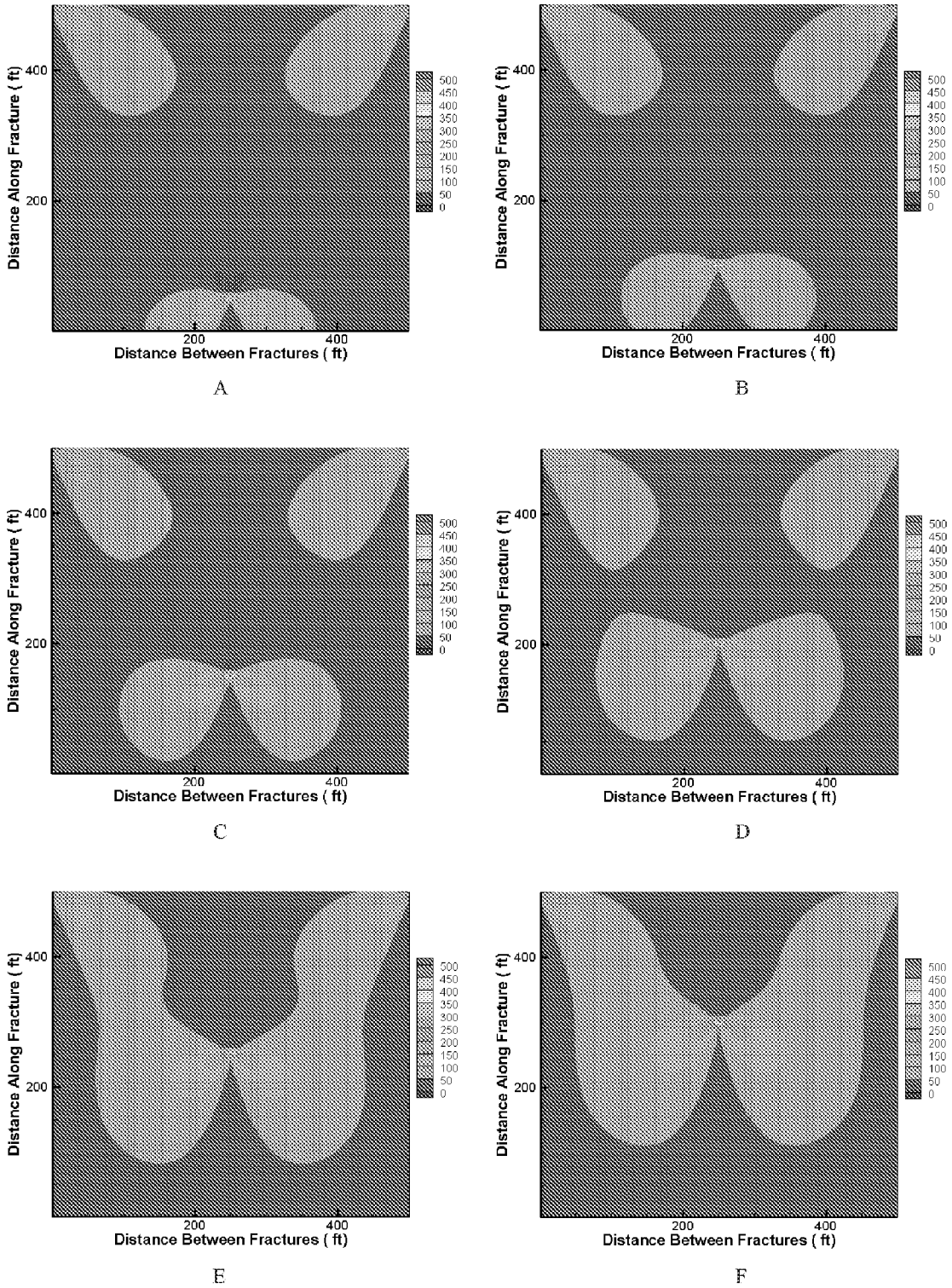
FIGS. 12A-12F are images of the change in shear stress for different fracture lengths (50, 100, 150, 200, 250, 300 ft).
Figures 13A, 13B, 13C, 13D, 13E, 13F:
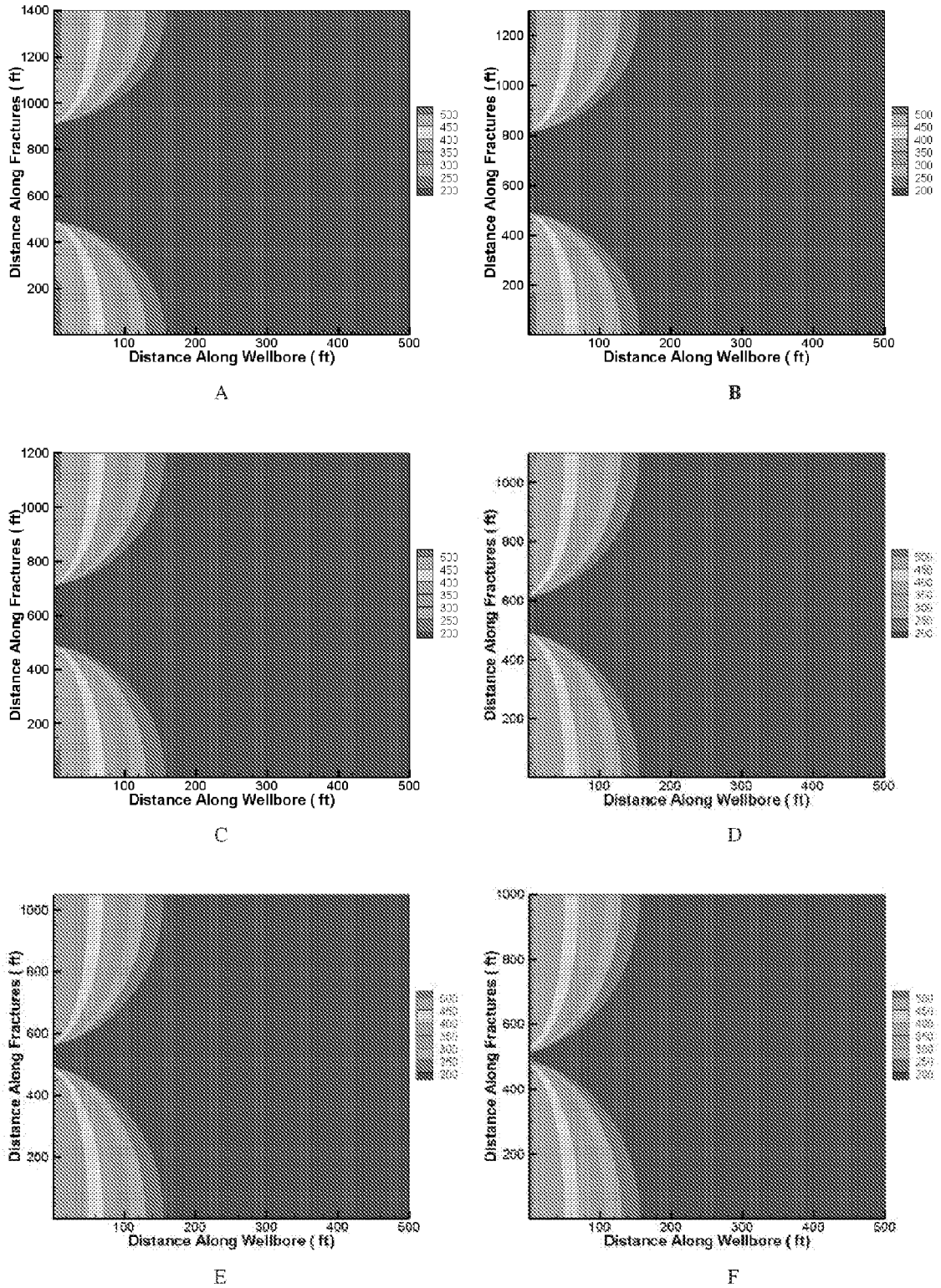
FIGS. 13A-13F are images of the change in minimum horizontal stress for different distances between the tips of the fractures (400, 300, 200, 100, 50, 25 ft).
Figure 14A:
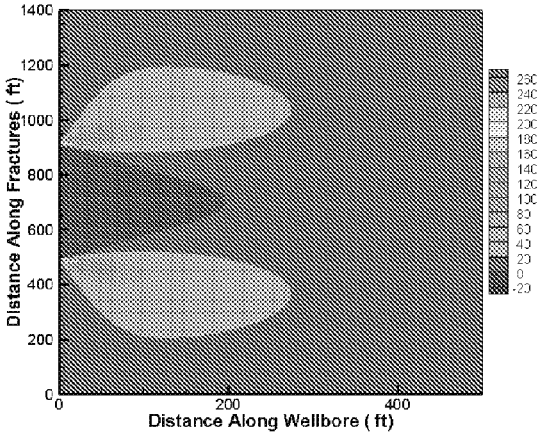
FIGS. 14A-14F are images of the change in shear stress for different distances between the tips of the fractures (400, 300, 200, 100, 50, 25 ft).
Figure 14B:
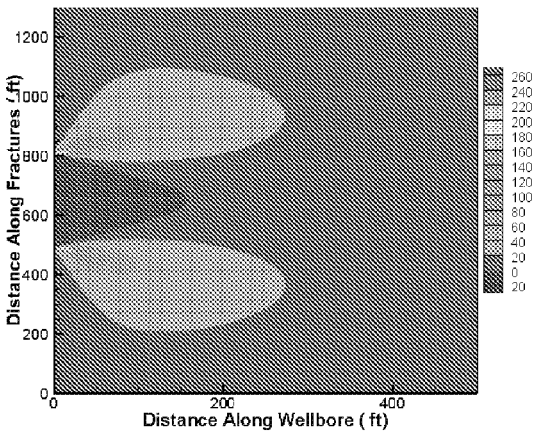
Figure 14C:
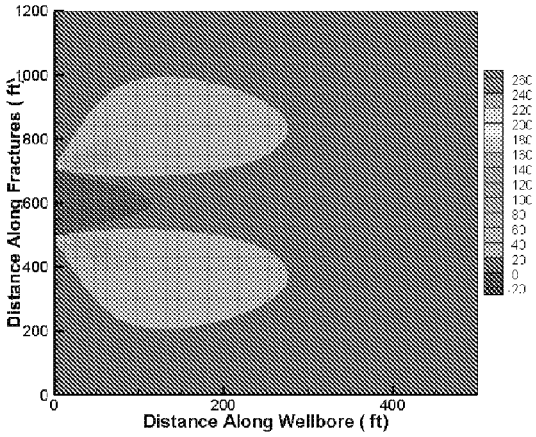
Figure 14D:
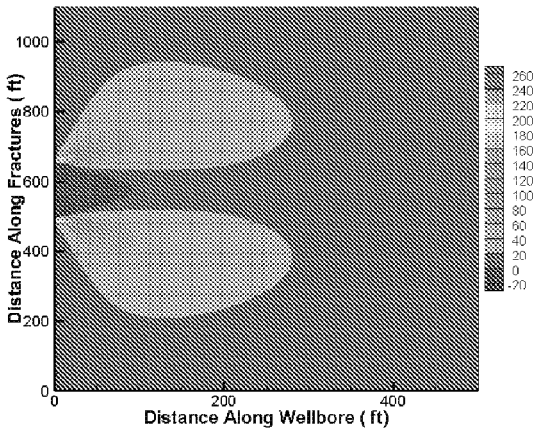
Figure 14E:
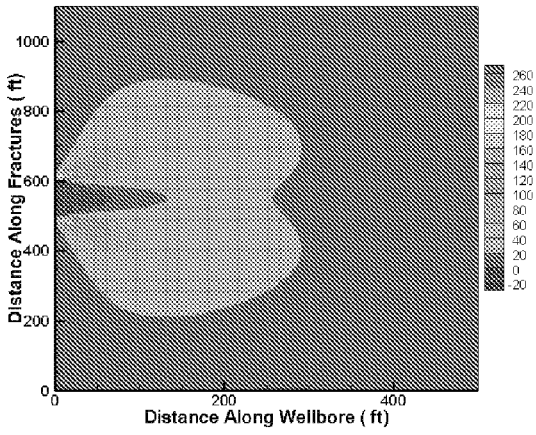
Figure 14F:
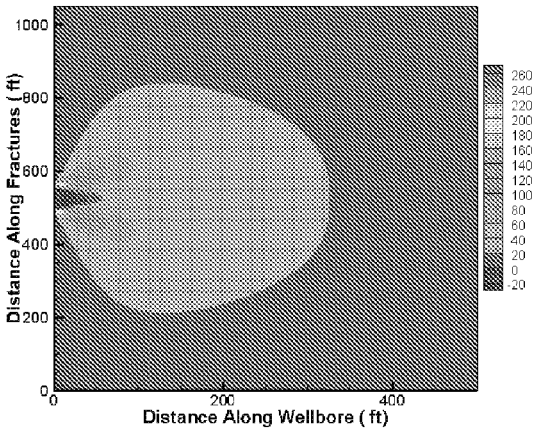

FIG. 9 is an image of a 3D visualization of change in minimum horizontal stress (psi). FIG. 10 is an image of a plan view of change in minimum horizontal stress (psi). Creating a single fracture (FIGS. 9 and 10) perturbs stress in the area surrounding the fracture. As shown in FIGS. 2, 4, and 5, the change in maximum horizontal stress by creating a single fracture is higher compared to the change in other two principal stresses. This change reduces the stress anisotropy (the difference between two horizontal principal stresses) and may activate the planes of weaknesses (fissures and natural fractures) in favor of creating a complex network connected to the main hydraulic fracture. When multiple fractures are created in a horizontal wellbore, the stress interference in the area between fractures increases. Considering the placement of fractures, if the increase in stress interference exceeds a certain limit, the stress field may reverse in the region near the wellbore and may result in longitudinal fractures. Longitudinal fractures are not of interest in horizontal wells where transverse fractures can be created instead to contact more of the reservoir. Thus, the placement of the fracture is critical when multiple transverse fractures are desired.

FIG. 10 (and all other further results) shows a plan-view of a quarter of the fracture with the wellbore passing through the center of the fracture. The fracture length remains constant at 492 ft for all cases. The contours in FIG. 10 show the stress induced by the open propped fracture. This stress is tensile near the tip of the fracture where significant change in shear stress is evident.

Recent attempts in fracturing designs have evaluated the effect of fracture spacing on the change in minimum horizontal stress, as it is an indication of change in stress anisotropy and also the fracture complexity. Alternating fracturing (Texas two-step) is one of the proposed methods in which fractures are created in an alternating sequence. After creating the first and the second interval, a third interval is placed between the two first fractures; this pattern will be repeated for the subsequent fractures. Any change in fracturing sequence alters the stress in the area between fractures and activates the stress-relieved fractures, which can create a complex network of fractures connected to the main hydraulic fractures. In this section, we investigate the effect of changing sequence and the change in minimum horizontal stress. The contours of change in minimum horizontal stress are shown in FIGS. 11A-F.

FIGS. 11A-11F are images of the change in Minimum Horizontal Stress (psi) for different fracture lengths (50, 100, 150, 200, 250, 300 ft). The spacing between the initial fractures should be chosen so that a pre-determined degree of interference exists between the two fractures. In this study, fractures were spaced 500 ft apart to simulate real field applications. The middle fracture was initiated at the center of the distance between the initial two fractures to mimic the alternating sequence and to evaluate the induced stress (FIGS. 11A-F). The change in the maximum horizontal stress is highly affected by the middle fracture propagation. The propagation of the middle fracture is highly dependent on the net pressure created by the previous fractures.

FIGS. 12A-12F are images of the change in shear stress (psi) for different fracture lengths (50, 100, 150, 200, 250, 300 ft). FIGS. 12A-F shows a significant change in shear stress near the tips of the fractures. This favorable change emits shear waives that can be captured by microseismic receivers as the tip of the fractures advances. Interpretation of microseismic events provides an accurate determination of fracture length during the treatment (Warpinski et al. 2004). The change in shear stress is significant near the tips, and as the middle fracture propagates, more of the reservoir will be exposed to the change in stress. This could potentially activate plains of weaknesses that exist in the heterogeneous non-conventional reservoirs such as shale plays. Although the alternating fracturing looks promising in the sense of creating a complex network, it is still a difficult practice to run in the field. Moreover, the risk of stress reversal near the wellbore and the creation of longitudinal fractures make this technique a second choice for operators.

It is possible for one to design the fractures to solely depend on shear effect (FIGS. 12A-F) to create conductivity inside the pre-existing planes of weaknesses. However the conductivity created in this fashion is usually low and it may quickly deteriorate. If the fractures are designed such that the net pressure would overcome the already reduced stress contrast (difference between the two horizontal stresses), the propagating middle hydraulic fracture would open the existing planes of weaknesses. In this case we could even place proppant inside both the hydraulic and the secondary fractures.

In the zipper-frac technique, two parallel horizontal wells are stimulated simultaneously (Waters et al. 2009). Roussel and Sharma (2010) numerically simulated the stress distribution around fractures in zipper-frac design to investigate the stress reversal in the region near the fractures. In zipper-frac, when the opposite fractures propagate toward each other, a degree of interference occurs between the tips of the fractures and forces the fractures to propagate perpendicular to the direction of the horizontal wellbore. FIGS. 13A-F show the effect of well spacing on stress changes in the surrounding fractures in a zipper-frac design. FIGS. 13A-13F are images of the change in minimum horizontal stress (psi) for different distances between the tips of the fractures (400, 300, 200, 100, 50, 25 ft).

FIGS. 14A-14F are images of the change in shear stress (psi) for different distances between the tips of the fractures (400, 300, 200, 100, 50, 25 ft). We expected to see a variation of change in stress behind the tips, but this change was minimal when compared to alternating fracturing. However, the contours of shear stress (FIGS. 14A-F) show significant change near the tips, which could result in changing the direction of fractures. Change in direction of fractures occurs if opposite fractures get very close, which raises the risk of well communication in return.

Figure 15:
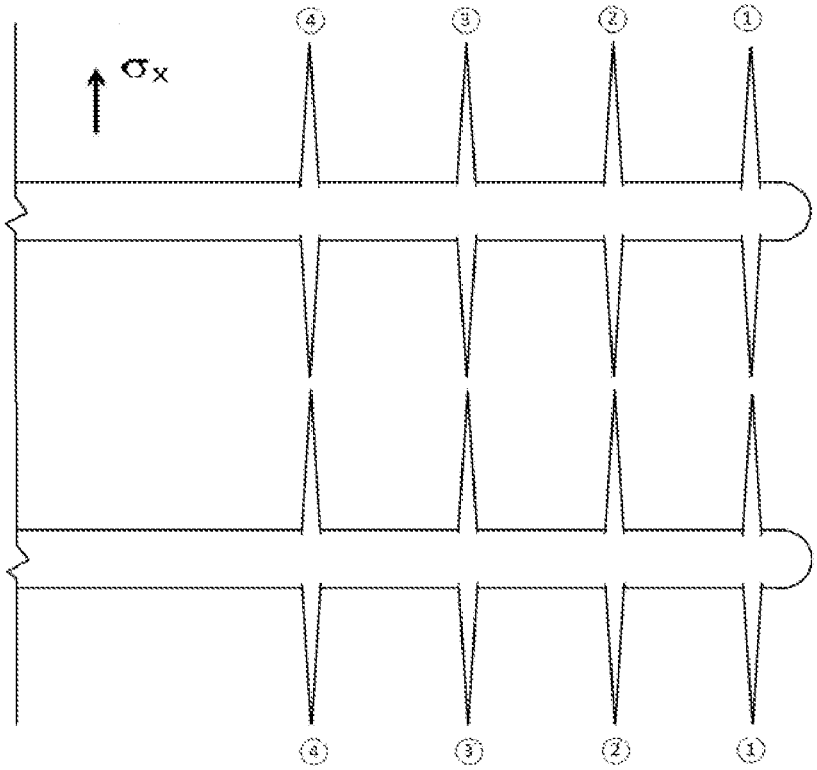
FIG. 15 is an image of the fracture placement in zipper-frac design.
Figure 16A:
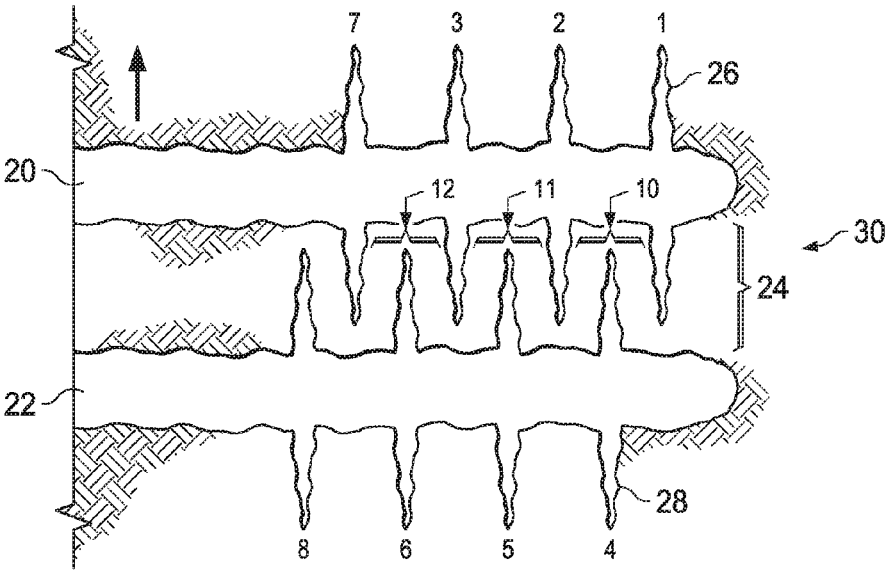
FIG. 16A is an image of a fracture placement in MZF design.

FIG. 15 is an image of the fracture placement in zipper-frac design. FIG. 16A is a fracture placement in MZF design. Modified Zipper-Frac (MZF). A new design in fracturing placement is developed to improve the stimulated reservoir volume (SRV) effectively (FIG. 16A). Similarly to zipper-frac (FIG. 15), MZF can be applied in multi-lateral completions where two or more laterals will be fractured to create a complex network. As mentioned before, the domination of stress perturbation in zipper-frac design is limited to the area near the tips, while in MZF the area between fractures will be altered by stress interference caused by the middle fracture initiated from the other lateral.

Figure 16B:
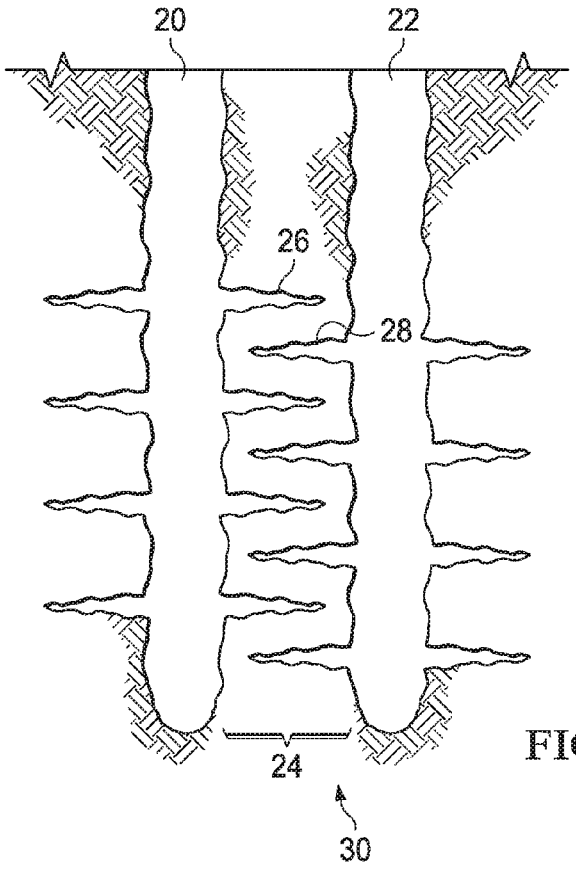
FIG. 16B is an image of the fracture placement in MZF design for two adjacent wellbores.
Figure 16C:
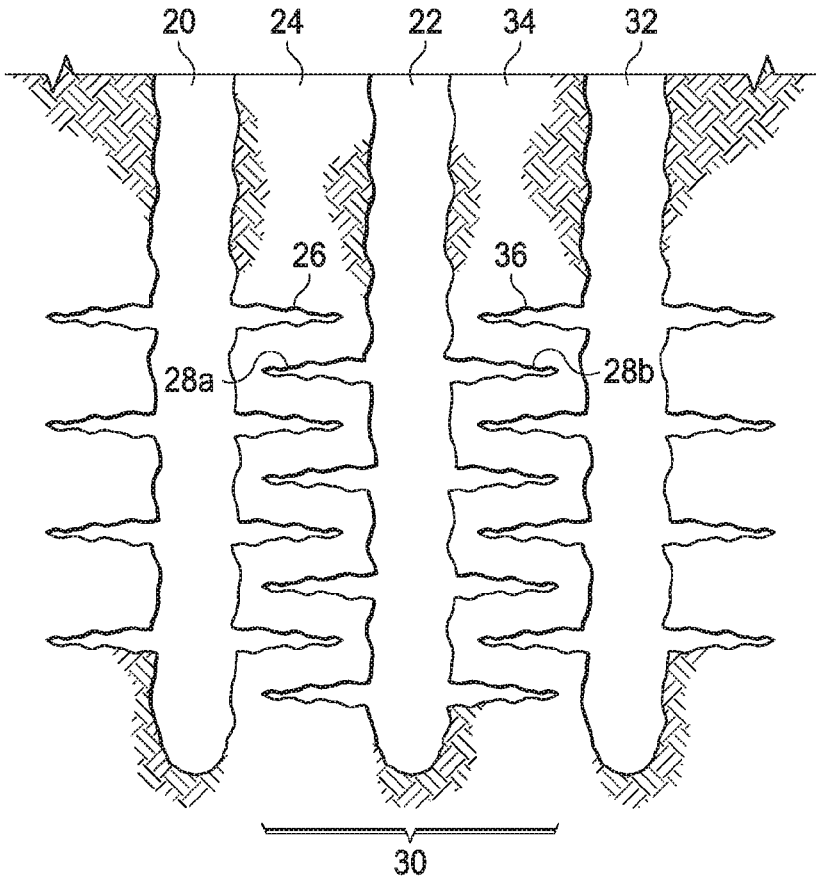
FIG. 16C is an image of the fracture placement in MZF design for three adjacent wellbores.
Figure 16D:
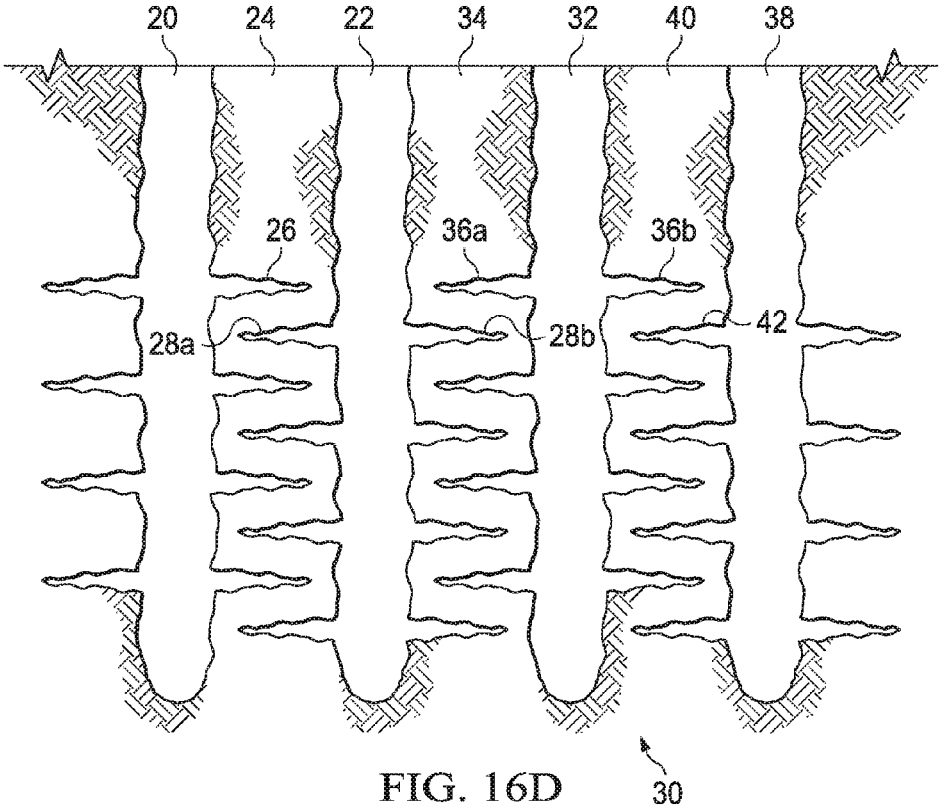
FIG. 16D is an image of the fracture placement in MZF design for four adjacent wellbores.
Figures 17A, 17B, 17C, 17D, 17E, 17F:
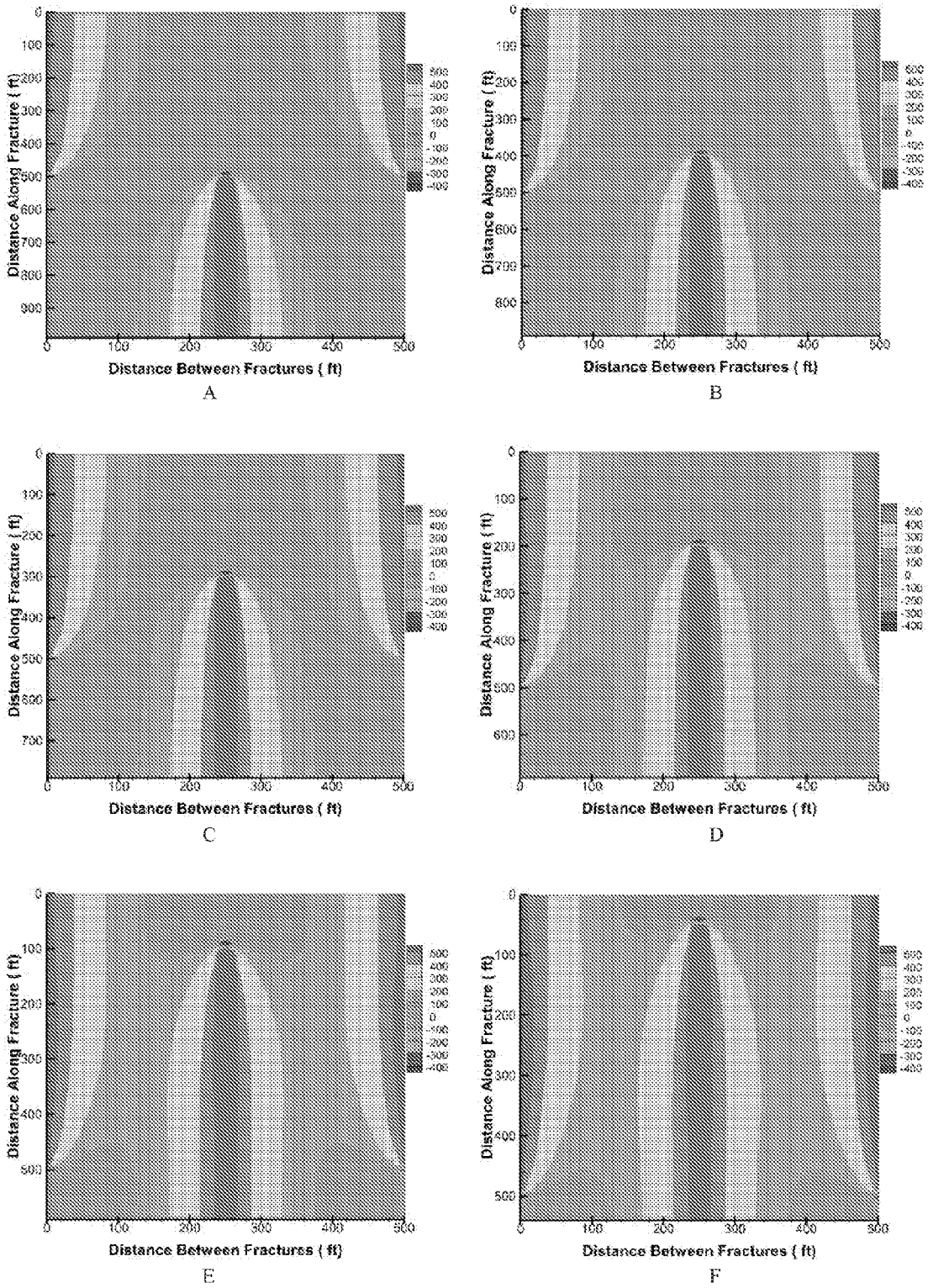
FIGS. 17A-17F are images of the change in minimum horizontal stress for different well spacings (1000, 900, 800, 700, 600, 550 ft).

FIG. 16A shows a new design in fracturing placement to improve the stimulated reservoir volume by forming a modified zipper-fracture pattern using adjacent and parallel first lateral wellbore 20 and second lateral wellbore 22 separated by an intermediate area 24. A first series of fractures 26 are produced in the first lateral wellbore 20 and extend into the intermediate area 24. The first series of fractures 26 include fractures 1, 2, 3, and 7 that extend on both sides of the first lateral wellbore 20. The second series of fractures 28 include fractures 4, 5, 6, and 8 that extend on both sides of the second wellbore 22. The placement of the second series of fractures 28 are optimized relative to the first series of fractures 26. In so doing fracture 4 is located between fracture 1 and fracture 2 in an intermediate zone 10 of the intermediate area 24; fracture 5 is located between fracture 2 and fracture 3 in an intermediate zone 11 of the intermediate area 24; fracture 6 is located between fracture 3 and fracture 7 in an intermediate zone 12 of the intermediate area 24; and fracture 8 is located adjacent to fracture 7. This modified zipper fraction pattern 30 is located in the intermediate area 24 including the intermediate zones 10-12 where fractures from the first series of fractures 26 alternate with the second series of fractures 28. FIG. 16B shows a new design in fracturing placement to improve the stimulated reservoir volume by forming a modified zipper-fracture pattern using two adjacent well bores. FIG. 16B illustrates a first lateral wellbore 20 adjacent and parallel to a second lateral wellbore 22 separated by an intermediate area 24. A first series of fractures 26 are produced in the first lateral wellbore 20 and extend into the intermediate area 24. A second series of fractures 28 in the second wellbore 22 that extend into the intermediate area 24 between the first series of fractures 26 to alter a stress field in the intermediate area 24 to optimize the placement of the second series of fractures 28 relative to the first series of fractures 26. This modified zipper fraction pattern 30 has an intermediate area 24 with fractures from the first series of fractures 26 alternating with the second series of fractures 28. FIG. 16C shows a new design in fracturing placement to improve the stimulated reservoir volume by forming a modified zipper-fracture pattern using multiple adjacent well bores. FIG. 16C illustrates a first lateral wellbore 20 adjacent and parallel to a second lateral wellbore 22 separated by an intermediate area 24. A first series of fractures 26 are produced in the first lateral wellbore 20 and extend into the intermediate area 24. A second series of fractures 28 in the second wellbore 22 that extend into the intermediate area 24 between the first series of fractures 26 to alter a stress field in the intermediate area 24 to optimize the placement of the second series of fractures 28 relative to the first series of fractures 26. This modified zipper fraction pattern 30 has an intermediate area 24 with fractures from the first series of fractures 26 alternating with the second series of fractures 28*a*. A third lateral wellbore 32 (or fourth, fifth etc.) can be introduced adjacent to the second lateral wellbore 22. This results in a second intermediate area 34 forming between the third lateral wellbore 32 and the second lateral wellbore 22. A third series of fractures 36 in the third wellbore 32 extend into a second intermediate area 34 between the second series of fractures 28*b* in an alternating sequence to alter a stress field in the second intermediate area 34 to optimize the placement of the second series of fractures 28 relative to the third series of fractures 36. This modified zipper fraction pattern 30 has an intermediate area 24 with fractures from the first series of fractures 26 alternating with the second series of fractures 28 and a second intermediate area 34 with fractures from the second series of fractures 28 relative to the third series of fractures 36. FIG. 16D shows the fracture placement in MZF design for four and numerous adjacent wellbores. FIG. 16D illustrates a first lateral wellbore 20 adjacent and parallel to a second lateral wellbore 22 separated by an intermediate area 24. A first series of fractures 26 are produced in the first lateral wellbore 20 and extend into the intermediate area 24. A second series of fractures 28 in the second wellbore 22 that extend into the intermediate area 24 between the first series of fractures 26 to alter a stress field in the intermediate area 24 to optimize the placement of the second series of fractures 28 relative to the first series of fractures 26. This modified zipper fraction pattern 30 has an intermediate area 24 with fractures from the first series of fractures 26 alternating with the second series of fractures 28*a*. A third lateral wellbore 32 (or fourth, fifth etc.) can be introduced adjacent to the second lateral wellbore 22. This results in a second intermediate area 34 forming between the third lateral wellbore 32 and the second lateral wellbore 22. A third series of fractures 36*a* in the third wellbore 32 extend into a second intermediate area 34 between the second series of fractures 28*b* in an alternating sequence to alter a stress field in the second intermediate area 34 to optimize the placement of the second series of fractures 28 relative to the third series of fractures 36*a*. A fourth lateral wellbore 38 (or fourth, fifth etc.) can be introduced adjacent to the third lateral wellbore 32. This results in a third intermediate area 40 forming between the third lateral wellbore 32 and the fourth lateral wellbore 38. A fourth series of fractures 42 in the fourth lateral wellbore 38 extend into the third intermediate area 40 between the third series of fractures 36*b* in an alternating sequence to alter a stress field in the third intermediate area 40 to optimize the placement of the fourth series of fractures 42 relative to the third series of fractures 36.

This modified zipper fraction pattern 30 has an intermediate area 24 with fractures from the first series of fractures 26 alternating with the second series of fractures 28 and an second intermediate area 34 with fractures from the second series of fractures 28 alternating with the third series of fractures 36 with fractures from the third series of fractures 36 alternating with the fourth series of fractures 42.

With MZF, we take advantage of both concepts developed in alternating fracturing and zipper-frac to create more complexity in the reservoir. However, unlike alternating fracturing, MZF is simple to practice without needing special downhole tools. In this design, fractures are placed in a staggered pattern to take advantage of the presence of a middle fracture for each two consecutive fractures.

FIGS. 17A-17F are images of the change in minimum horizontal stress (psi) for different well spacings (1000, 900, 800, 700, 600, 550 ft). FIGS. 17A-F shows the effect of well spacing on the change in induced stress in the area surrounded by the two laterals and three fractures. When the well spacing decreases from 1,000 to 450 ft, the maximum horizontal stress increases about 200-300 psi from the original state. The practical limitations should be carefully considered in this design. Fractures initiated in one lateral should not extend too long to reach the other lateral as some completion damages could occur. This change is enough to reduce the stress anisotropy and activate the pre-existing natural fractures in the formation. The risks of stress reversal near the wellbore as well as well communication are minimal compared to the other designs. While MZF shows improvement in fracture complexity from a geomechanical viewpoint, it also shows promise in enhancing long term production of the reservoir from a fluid flow aspect. The next section describes the fluid flow aspect of different designs in fracturing.

Fracture complexity significantly increases the contact area, which is the key for improving productivity in tight formations. This is particularly important in the case of shale formations. The area of improved contact area is commonly referred to as stimulated reservoir volume, or SRV. The SRV has been simulated in literature as either disceret fractures or as improved conductivity area. In this study, we investigated SRV as an improved conductivity area, which surrounded the whole fracture system tip to tip.

Figure 18:
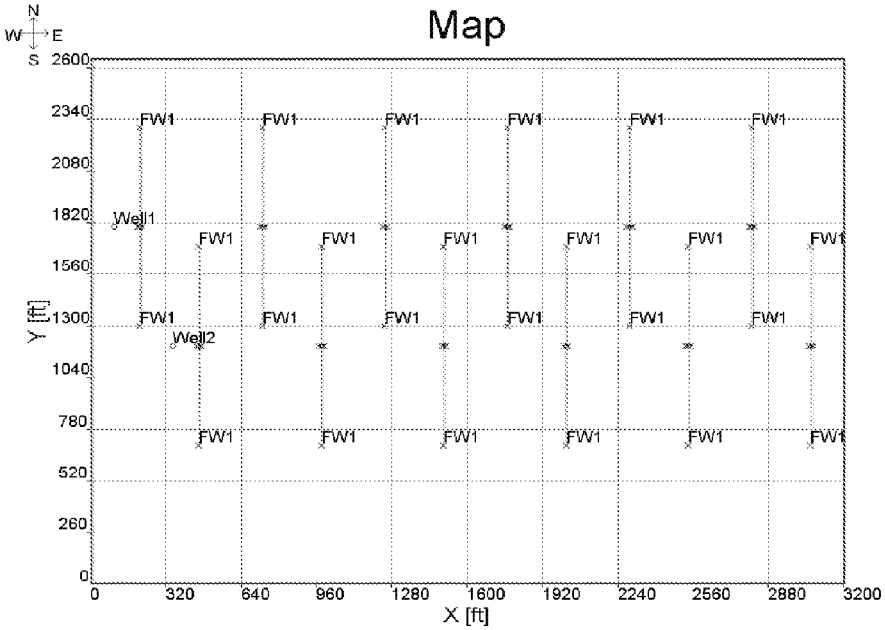
FIG. 18 is an image of the fractures in modified zipper frac (MZF) map.
Figure 19:
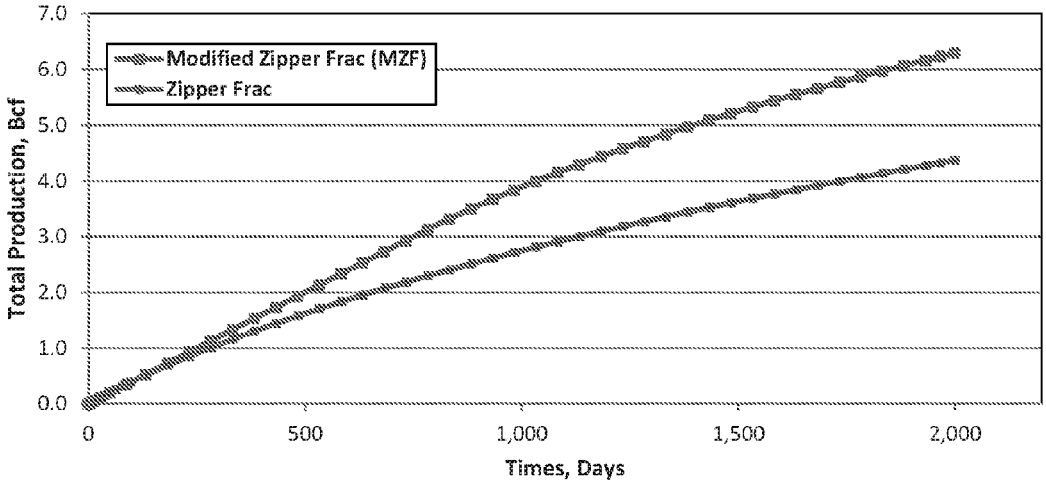
FIG. 19 is an image of the effect of fracture placement on total production.
Figure 20:
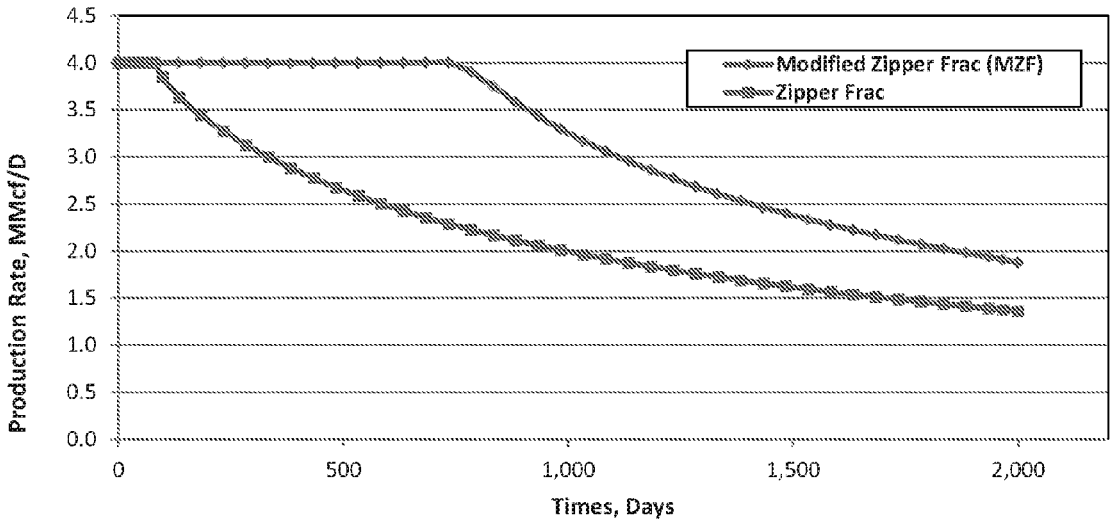
FIG. 20 is an image of the effect of fracture placement on production rate.

FIG. 18 is an image of the fractures in modified zipper frac (MZF) map. FIG. 18 shows the placement of fractures in the modified zipper frac design where two horizontal wellbores were created using a numerical simulator. A permeablity of 1 μD was assumed for the formation, where six fractures were placed 500 ft apart in two wells. Fracture height and length were assumed to be 500 ft and 200 ft, respectively. The two wells were spaced 600 ft apart, and Well 2 was shifted so that a pattern of MZF was produced. In another case, to simulate zipper frac design, wells were spaced 1020 ft apart where the tips of opposite fractures became very close (only 20 ft apart). A maximum of 4MMCF/D of rate and a minimum of 500 psi was allowed. Simulation results show an improvement of 44% in cumulative gas production in MZF design over zipper frac due to the enhancement in fracture complexity (FIG. 19). FIG. 19 is an image of the effect of fracture placement on total production. The effect of fracture placement on production rate is shown in FIG. 20. FIG. 20 is an image of the effect of fracture placement on production rate.

In this paper we reviewed the existing techniques for creating far field fracture complexity and presented a new method to generate the desired far field fracture complexity. Our analysis indicates that stress interference does not affect areas beyond the tip of the created hydraulic fracture; the shear stress effect does extend beyond the tip of the created fractures. However, it may not be sufficient to create a durable complexity, especially in softer formations. The alternating fracture approach is a viable approach, but it presents the operator with operational issues. A standard design calls for progressively fracturing a horizontal well from the toe toward the heel. Alternating fracturing does not follow that simple approach but, rather, goes back and forth inside highly desirable to achieve the same goal while eliminating those problems.

The proposed modified zipper frac is shown to be capable of doing exactly that: It has the advantage of creating the desired far field complexity associated with alternating fracturing with no operational issues. The technique requires fracturing two wells simultaneously, thereby forcing the fracture length to grow long enough to cause stress interference and to create the desired complexity. Based on the analysis in this study, the following conclusions are be drawn:

Fractures with the length/height ratios greater than 5 can be assumed and modeled as semi-infinit fractures.

Alternating fracturing has great potential to increase fracture complexity; however, it is operationally difficult to practice.

The tips of fractures in zipper frac design must be very close to achieve the stress interference effect near the tips. This increases the risk of well communication and might result in lower gas production.

By decreasing the well spacing in the MZF design, the chance of creating more complexity increases; however, the practical limitations should be carefully considered.

Modified zipper farc design can potentially increase the stress interference between the fractures and create an effective SRV to enhance hydrocarbon production.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

REFERENCES

Cipolla, C. L., Lolon, E., Erdle, J. C., and Rubin, B. 2009. Reservoir Modeling in Shale-Gas Reservoirs. Paper SPE 125530-MS presented at the SPE Eastern Regional Meeting, Charleston, W. Va., USA, 23-25 September.

Cipolla, C. L., Warpinski, N. R., Mayerhofer, M., Lolon, E. P., and Vincent, M. 2010. The Relationship Between Fracture Complexity, Reservoir Properties, and Fracture-Treatment Design. *SPE Production & Operations* (4): 438-452.

East, L. E., Soliman, M. Y., and Augustine, J. R. 2010. Methods for Enhancing Far-field Complexity in Fracturing Operations. *SPE Production & Operations* (3): 291-303.

Green, A. E. and Sneddon, I. N. 1950. The Distribution of Stress in the Neighbourhood of a Flat Elliptical Crack in an Elastic Solid. *Mathematical Proceedings of the Cambridge Philosophical Society* 46 (1): 159-163.

Mayerhofer, M. J., Lolon, E., Warpinski, N. R., Cipolla, C. L., Walser, D. W., and Rightmire, C. M. 2010. What Is Stimulated Reservoir Volume? *SPE Production & Operations* (1): 89-98.

Mayerhofer, M. J., Lolon, E., Warpinski, N. R., Cipolla, C. L., Walser, D. W., and Rightmire, C. M. 2008. What is Stimulated Rock Volume? Paper SPE 119890-MS presented at the SPE Shale Gas Production Conference, Fort Worth, Tex., USA, February.

Nagel, N. B. and Sanchez-Nagel, M. 2011. Stress Shadowing and Microseismic Events: A Numerical Evaluation. Paper SPE 147363-MS presented at the SPE Annual Technical Conference and Exhibition, Denver, Colo., USA, 30 October-2 November.

Navigant Consulting. 2008. North America Natural Gas Assessment. Prepared for American Clean Skies Foundation.

Roussel, N. P., and Sharma, M. M. 2011. Strategies to Minimize Frac Spacing and Stimulate Natural Fractures in Horizontal Completions. Paper SPE 146104-MS presented at the SPE Annual Technical Conference and Exhibition, Denver, Colo., USA, 30 October-2 November.

Roussel, N. P. and Sharma, M. M. 2011. Optimizing Fracture Spacing and Sequencing in Horizontal-Well Fracturing. *SPE Production & Operations* (2): 173-184.

Sneddon, I. N. 1946. The Distribution of Stress in the Neighborhood of a Crack in an Elastic Solid. Proceedings of the Royal Society of London, A (187): 229-60.

Sneddon, I. N. and Elliott, H. A. 1946. The Opening of a Griffith Crack under Internal Pressure. *Quarterly of Applied Mathematics* 4 (3): 262-267.

Soliman, M. Y., East, L. E., and Adams, D. 2008. Geomechanics Aspects of Multiple Fracturing of Horizontal and Vertical Wells. *SPE Drilling & Completion* (3): 217-228.

Soliman, M. Y., East, L. E., and Augustine, J. R. 2010. Fracturing Design Aimed at Enhancing Fracture Complexity. Paper SPE 130043-MS presented at the SPE EUROPEC/EAGE Annual Conference and Exhibition, Barcelona, Spain, 14-17 June.

Warpinski, N. R., Mayerhofer, M. J., Vincent, M. C., Cipolla, C. L., and Lolon, E. P. 2009. Stimulating Unconventional Reservoirs: Maximizing Network Growth While Optimizing Fracture Conductivity. Journal of Canadian Petroleum Technology (10): 39-51.

Warpinski, N. R., Wolhart, S. L., and Wright, C. A. 2004. Analysis and Prediction of Microseismicity Induced by Hydraulic Fracturin. *SPE Journal* (1): 24-33.

Waters, G. A., Dean, B. K., Downie, R. C., Kerrihard, K. J., Austbo, L., and McPherson, B. 2009. Simultaneous Hydraulic Fracturing of Adjacent Horizontal Wells in the Woodford Shale. SPE paper 119635-MS presented at the SPE Hydraulic Fracturing Technology Conference, Woodlands, Tex., 19-21 January.

What is claimed is:

1. A method of hydraulically fracturing a subterranean formation to form a complex modified zipper fracture pattern of hydraulically spaced fractures between adjacent wellbores comprising steps of:

identifying at least a first wellbore and a second wellbore that are laterally parallel in a subterranean formation;

forming a modified zipper fracture pattern between the first wellbore and the second wellbore, wherein the modified zipper fracture pattern is formed by:

(a) introducing a first fracture, a second fracture, and a third fracture in the first wellbore;

(b) introducing in the second wellbore a fourth fracture that extends to a first intermediate area between the first fracture and the second fracture to alter the stress field in the first intermediate zone; and (c) introducing in the second wellbore a fifth fracture that extends to a second intermediate area between the second fracture and the third fracture to alter the stress field in the second intermediate zone; and forming one or more complex modified zipper fracture pattern by repeating steps (a), (b) and (c) to extend the modified zipper fracture pattern.

2. The method of claim 1, further comprising the step of introducing a third parallel lateral wellbore in the subterranean formation parallel to the second wellbore and introducing a third wellbore fracture in the third parallel lateral wellbore between the fourth fracture and the fifth second fracture that extends to the first a third intermediate zone between the fourth fracture and the fifth second fracture to alter the stress field in the third intermediate area.

3. The method of claim 1, wherein the complex modified zipper fracture pattern connects to one or more pre-existing networks of natural fractures.

4. The method of claim 1, wherein the fourth fracture and the fifth fracture reduce a stress anisotropy between a first and second horizontal stress.

5. The method of claim 1, wherein the fourth fracture and the fifth fracture change the magnitude of horizontal stresses.

6. The method of claim 1, wherein the fractures form in more than one direction.

7. The method of claim 1, wherein the subterranean formation comprises a shale or a tight sand reservoir.

8. The method of claim 1, wherein the first wellbore, the second wellbore or both are deviated wellbores.

9. A method of altering the stress anisotropy in a subterranean formation by hydraulically fracturing in a specific modified zipper sequence comprising the steps of:

identifying at least two parallel lateral wellbores in a subterranean formation comprising at least a first wellbore and a second wellbore;

forming a modified zipper fraction pattern comprising one or more modified zipper fraction pattern segments each comprising:

introducing at least forming a first fracture in the first wellbore to generate a first stress field;

forming a second fracture in the first wellbore to generate a second stress field;

forming a third fracture in the second wellbore that extends between the first fracture and the second fracture to generate a third stress field, wherein the third stress field extends to an intermediate area between the first stress field and the second stress field to alter a regional stress field so that the difference between the first stress field and the second stress field approaches zero; and forming one or more complex fractures extending from the first fracture, the second fracture, the third fracture or a combination thereof to form a complex fracture network.

10. The method of claim 9, further comprising the step of extending the modified zipper fraction pattern by adding one or more modified zipper fraction pattern segments.

11. The method of claim 9, wherein the one or more complex fractures connects to one or more pre-existing networks of natural fractures to form the complex fracture network.

12. The method of claim 9, wherein the one or more complex fractures form in more than one direction.

13. The method of claim 9, wherein the subterranean formation comprises a shale or a tight sand reservoir.

14. The method of claim 9, wherein the two or more parallel lateral wellbores are deviated wellbores.

15. A method of optimizing the placement of fractures along deviated wellbores comprising steps of:

identifying at least two parallel lateral wellbores in a subterranean formation comprising at least a first wellbore and a second wellbore;

forming a modified zipper fraction pattern between the first wellbore and the second wellbore by forming a first series of fractures in the first wellbore that extend toward the second wellbore into an intermediate area; and forming a second series of fractures in the second wellbore that extend into the intermediate area between the first series of fractures to alter a stress field in the intermediate area to optimize the placement of fractures.

16. The method of claim 15, further comprising the step of introducing a third parallel lateral wellbore in the subterranean formation parallel and adjacent to the second wellbore; forming a third series of fractures in the third wellbore that extend into a third intermediate area between the second series of fractures to alter the stress field.

17. The method of claim 16, further comprising the step of introducing a fourth parallel lateral wellbore in the subterranean formation parallel and adjacent to the first wellbore, the second wellbore or the third wellbore, forming a fourth series of fractures in the fourth wellbore that extend into a fourth intermediate area between the first series of fractures, the second series of fractures or the third series of fractures to alter the stress field.

18. The method of claim 15, further comprising the step of extending the modified zipper fraction pattern between the first wellbore and the second wellbore by adding one or more modified zipper fraction patterns.

* * * * *